US010888756B1

(12) United States Patent
Vasi

(10) Patent No.: US 10,888,756 B1
(45) Date of Patent: Jan. 12, 2021

(54) FIELD GAME KIT AND METHOD

(71) Applicant: Frank Vasi, Holmes, NY (US)

(72) Inventor: Frank Vasi, Holmes, NY (US)

( * ) Notice: Subject to any disclaimer, the term of this patent is extended or adjusted under 35 U.S.C. 154(b) by 0 days.

(21) Appl. No.: 16/207,306

(22) Filed: Dec. 3, 2018

Related U.S. Application Data

(60) Provisional application No. 62/593,771, filed on Dec. 1, 2017.

(51) Int. Cl.

| | |
|---|---|
| ***A63B 69/00*** | (2006.01) |
| ***A63B 67/02*** | (2006.01) |
| ***A63B 71/02*** | (2006.01) |
| ***A63B 71/06*** | (2006.01) |

(52) U.S. Cl.
CPC ..... *A63B 67/02* (2013.01); *A63B 71/02* (2013.01); *A63B 71/06* (2013.01); *A63B 69/00* (2013.01); *A63B 69/0002* (2013.01)

(58) Field of Classification Search
CPC ..... A63B 67/02; A63B 71/02; A63B 71/06; A63B 69/0002; A63B 69/00
USPC ..... 473/451, 422, 452, 497
See application file for complete search history.

(56) References Cited

U.S. PATENT DOCUMENTS 3,874,662 A * 4/1975 Harrington ..... A63B 69/0075 473/417
4,057,248 A * 11/1977 Stoecker ..... A63B 69/0002 473/451
5,000,449 A * 3/1991 Weeks ..... A63B 69/0002 473/452
5,056,781 A * 10/1991 Preston ..... A63B 69/0079 473/423
5,058,889 A * 10/1991 Burton ..... A63B 69/0002 473/452
5,385,343 A * 1/1995 Davis, Sr. ..... A63B 69/0002 473/452
5,540,430 A * 7/1996 Nichols ..... A63B 69/0002 473/417
5,639,243 A * 6/1997 Ryan ..... A63B 69/0002 473/451
6,224,522 B1 * 5/2001 Ervin ..... A63B 69/0057 482/121
6,500,078 B1 * 12/2002 Williams ..... A63B 69/0002 473/218
6,932,712 B2 * 8/2005 Cardosi ..... A63B 69/3641 473/261
7,338,395 B1 * 3/2008 Hurley ..... A63B 69/0002 473/454
7,896,759 B2 * 3/2011 Jackson ..... A63B 71/06 473/452

(Continued)

*Primary Examiner* — Mitra Aryanpour
(74) *Attorney, Agent, or Firm* — John Rizvi; John Rizvi, P.A.—The Patent Professor®

(57) ABSTRACT

A field game system and method is disclosed by which multiple players can play a game that combines ball pitching, striking and catching with running. The system includes a visual indicator defining an elongated game lane. A hitting zone indicator may be provided at a proximal end of the game lane, delineating a hitting zone. At least one pitching zone indicator may be provided to indicate a pitcher's position. At least one running distance indicator may be provided along the game lane to indicate one or more running distances. The field game system may further include a standing mat, ball and club or other ball-hitting device for striking the ball beyond the hitting zone.

19 Claims, 9 Drawing Sheets

(56) References Cited

U.S. PATENT DOCUMENTS

| | | | | |
|---|---|---|---|---|
| 9,227,124 | B1 * | 1/2016 | Sparks | A63B 69/0002 473/452 |
| 9,242,160 | B2 * | 1/2016 | Tyndall | A63B 69/0013 473/452 |
| 9,750,997 | B2 * | 9/2017 | Frampton | A63B 69/0002 473/452 |
| 2006/0068947 | A1 * | 3/2006 | Kempf | A63B 69/0002 473/451 |
| 2006/0211522 | A1 * | 9/2006 | Hapanowicz | A63B 69/0002 473/452 |
| 2011/0021296 | A1 * | 1/2011 | Johnston | A63B 69/0002 473/452 |
| 2011/0092318 | A1 * | 4/2011 | Torch | A63B 69/0002 473/452 |
| 2016/0236053 | A1 * | 8/2016 | Frampton | A63B 69/0002 473/452 |

* cited by examiner

FIELD GAME KIT AND METHOD

CROSS REFERENCE TO RELATED APPLICATION

This application claims the benefit of U.S. Provisional Patent Application Ser. No. 62/593,771, filed on Dec. 1, 2017, which is incorporated herein in its entirety.

FIELD OF THE INVENTION

The present invention relates generally to games, and more particularly, to a field game system and method by which multiple players can play a game that combines ball pitching, striking and catching skills of the players with running to aerobically condition the players.

BACKGROUND OF THE INVENTION

In the game of baseball, two teams, each having nine players, take turns batting a ball which is pitched by a player on the other team. After hitting the ball by swinging a bat, each player on the batting team attempts to score a run by running counter-clockwise around first, second, third bases and a home plate arranged around a playing field, or "baseball diamond". A player scores a run by advancing around the bases and returning to home plate.

The fielding team tries to prevent the players on the batting team from completing runs by outing the batting players in any of several ways. In the event that a batting player swings at the ball and misses on three attempts, that batting player is out. As a batting player advances from one base to another base or to home plate during the batting of another player on the batting team, a player on the fielding team can throw the ball to the fielding team player at the next base in the series. If the fielding player catches the ball and then touches the base before the batting player reaches the base, then that batting player is out. Likewise, the batting player is out if one of the fielding players catches the batted ball. In some cases, the batting player may be outed if he hits a foul ball, or the batted ball flies outside the boundaries of the baseball diamond. A baseball game is composed of nine innings, and the team with the greater number of runs at the end of the game wins the game.

Golf is a popular game in which a player strikes a golf ball from a tee box using a club having an elongated shaft and a club head on the shaft. In as few strokes of the club as possible, the player attempts to land the ball in a hole on a golf green which is located at a distance from the tee box. Accuracy in achieving the correct trajectory of the ball on each stroke depends largely on the integrity of the swing of the club as the player strikes the ball.

Both baseball and golf provide hours of entertainment to millions of participants each year worldwide. These sports also develop and test a player's skills and coordination in accurately striking a ball in order to achieve a desired trajectory of the ball. In addition, baseball develops and tests players' skills in catching a ball and aerobically conditions players as they advance around the bases and home plate of the baseball diamond.

While baseball and golf are extremely popular sports, they generally require a large amount of space and are thus impossible to play on an ordinary lawn or yard available at people's homes or parks. Furthermore, playing golf or baseball on a private lawn, at a public park, or the like, may put other nearby people at risk of being hit by a ball and suffering extremely serious physical damage. Furthermore, baseball and golf may require purchasing a relatively large amount of equipment which may often be excessively costly for the ordinary amateur player and may require a large storage space.

Accordingly, alternative ball-hitting games or sports are desired which solve at least one of the aforementioned problems. For example, ball-hitting games or sports are needed which can be safely and conveniently played in non-specialized areas such as private yards or public parks, and can thus be played by a wide variety of people.

SUMMARY OF THE INVENTION

The present invention is directed to a field game system and method by which multiple players can play a game that combines ball pitching, striking and catching skills of the players with running to aerobically condition the players. The field game system may include a game lane indicator defining an elongated game lane for a player to run along. A hitting zone may be delineated by at least one hitting zone indicator. At least one pitching zone indicator may indicate a pitching zone within the game lane to be occupied by a pitcher. At least one running distance indicator, which may include intermediate length indicator(s) and/or a finish indicator, may be provided indicating one or more running distances with respect to the hitting zone; for instance and without limitation, running distance indicators can be arranged at 60 feet, 70 feet, 80 feet, and 90 feet with respect to the hitting zone.

In typical application of the field game method, a hitter may stand at the hitting zone as a pitcher stands at the pitching zone and pitches a game ball at the hitter. The hitter may attempt to strike the pitched game ball using a club. The hitter may score a point by running from the hitting zone along the game lane to one or more of the running distance indicators (including the finish indicator). Outfielders standing outside the game lane may attempt to catch the game ball or cause the game ball to contact the hitter to score an out which ends the hitter's turn. The game may instill and enhance ball pitching, striking and catching skills of players as well as aerobically condition the players.

In a first implementation of the invention, a field game system comprises at least one game lane indicator, at least one hitting zone indicator, at least one pitching zone indicator and at least one running distance indicator. The at least one game lane indicator defines an elongated game lane for running therealong, the game lane comprising a proximal end and a distal end. The least one hitting zone indicator indicates a hitting zone within the game lane to be occupied by a hitter for the hitting of a ball. The at least one pitching zone indicator indicates a pitching zone within the game lane to be occupied by a pitcher, wherein the pitching zone is arranged distally to the hitting zone. In turn, the at least one running distance indicator indicates one or more specific running distances with respect to the hitting zone, wherein the one or more specific running distances are located distally to the pitching zone.

In a second aspect, the at least one game lane indicator can include a pair of lane edge markers arranged in a spaced-apart relationship with one another defining the game lane therebetween.

In another aspect, each lane edge marker can include a flexible band.

In another aspect, the at least one hitting zone indicator can include at least one hitting zone mark on at least one of the lane edge markers.

In another aspect, the at least one pitching zone indicator can include at least one visible mark on at least one of the lane edge markers.

In another aspect, the at least one running distance indicator can include at least one visible mark on at least one of the lane edge markers.

In another aspect, the at least one running distance indicator can include a plurality of pairs of visible marks arranged along the lane edge markers at increasing distances from the hitting zone.

In another aspect, the at least one hitting zone indicator can include a standing plate.

In another aspect, the at least one hitting zone indicator and hitting zone can be located at a proximal end of the game lane.

In another aspect, the system can further include at least one game point indicator indicating a transverse game point line at a position along the game lane which is located distally to the hitting zone and proximally to the pitching zone.

In another aspect, the at least one game point indicator can include at least one visible mark on at least one of the lane edge markers.

In another aspect, the system can further comprise one or more ball-hitting devices configured to allow a hitter in the hitting zone to hit a ball pitched to the hitter from the pitching zone.

In another aspect, the one or more ball-hitting devices can include a club.

In another aspect, the system can further include a ball configured to be hit by the one or more ball-hitting devices.

In another aspect, the system can further comprise one or more flags configured to provide a visual reference of at least one of the hitting zone, the pitching zone and the one or more specific running distances.

In another aspect, the one or more flags can be located on the pair of lane edge markers.

In another aspect, the one or more flags can be removably fitted within one or more corresponding openings in the pair of lane edge markers.

In another aspect, the one or more flags can be height-adjustable.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a field game system or kit, and method, by which multiple players can play a game that combines ball pitching, striking and catching skills of the players with running to aerobically condition the players.

Figure 1:
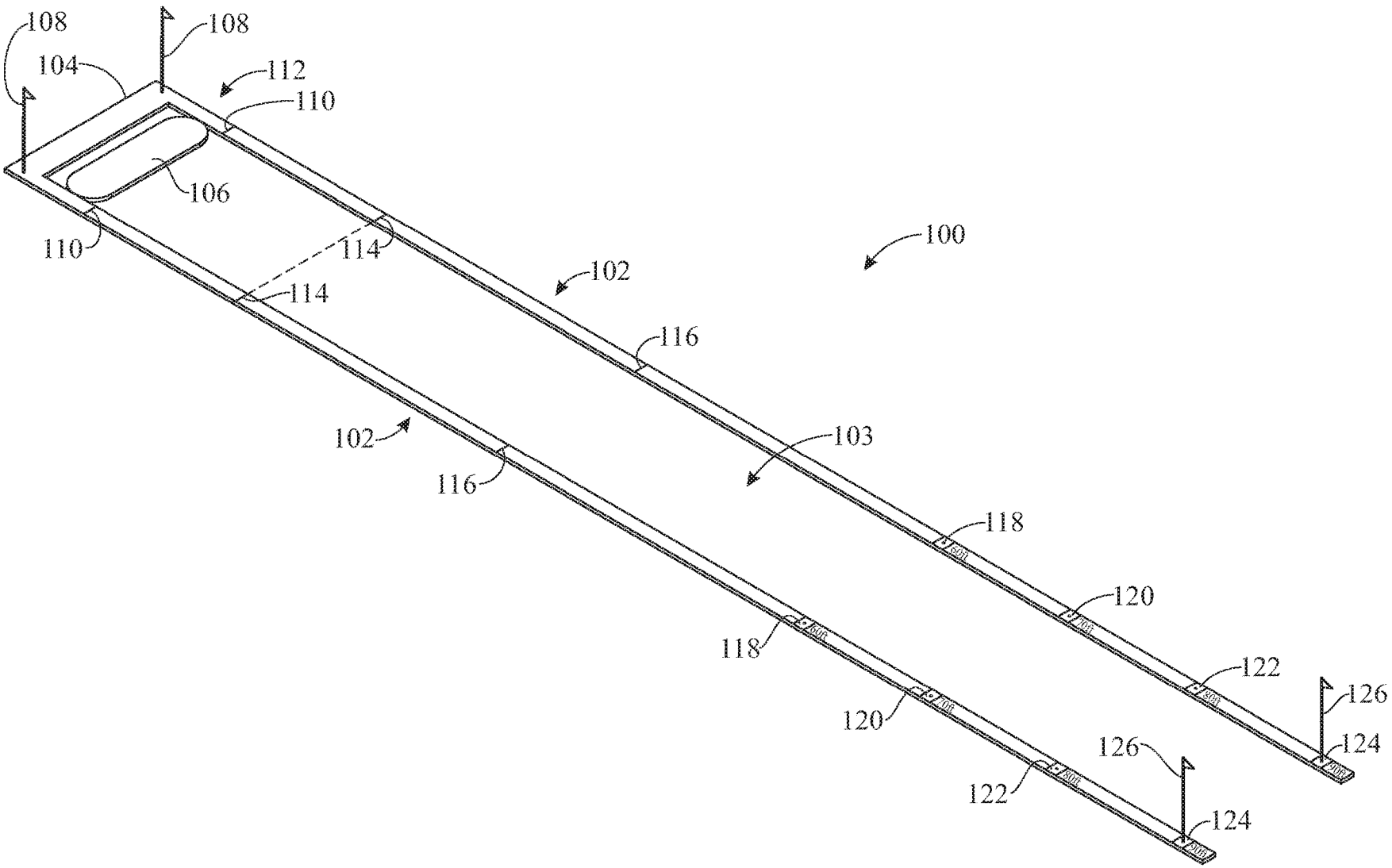
FIG. 1 presents a perspective view showing a field game system in accordance with an illustrative embodiment of the present invention.

Referring initially to FIGS. 1-3 and 7-10, a field game kit or system 100 is illustrated in accordance with an exemplary embodiment of the present invention. The field game system 100 may include a pair of generally elongated, parallel, spaced-apart lane edge markers 102. The lane edge markers 102 may be fabricated of a flexible plastic or fabric material, or other material which is consistent with the functional requirements of the field game system 100. For example and without limitation, in some embodiments, the lane edge markers 102 may be formed as a flexible band or strap made of plastic, fabric or other material which can be deployed or extended as shown in FIG. 1 and is sufficiently thin and flexible to facilitate folding or rolling of the lane edge markers 102 for compact and space-efficient transport and/or storage. In some embodiments, each lane edge marker 102 may be assembled from multiple marker segments (not illustrated) which can be selectively attached to each other in end-to-end relationship to each other according to the knowledge of those skilled in the art. Accordingly, the marker segments of the lane edge markers 102 may be selectively detached from each other to facilitate compact and space-efficient transport and/or storage of the lane edge markers 102 and other components of the field game system 100, which will be hereinafter described.

As further shown in FIG. 1, the lane edge markers 102 may be deployed in a spaced-apart, preferably parallel relationship such that an elongated game lane 103 is formed by and between the lane edge markers 102 in a longitudinal direction 150. In some embodiments, a marker connector 104 may connect the lane edge markers 102 to each other, such as at a first or proximal end of the lane edge markers 102. The marker connector 104 may be detachably attached to the lane edge markers 102 or placed on the lane edge markers 102.

A club zone or hitting zone 112 may be provided for a player to hit the ball therefrom, as will be described in detail hereinafter. Preferably, the hitting zone 112 is located at a proximal end of the game lane 103 defined by the lane edge markers 102, adjacent to the marker connector 104. At least one club zone marker or hitting zone marker 110 may be provided on at least one of the lane edge markers 102, providing a visual indication to the user that he or she shall hit the ball from the zone (hitting zone 112) marked by the at least one hitting zone marker 110. In some embodiments, more specifically, a pair of hitting zone markers 110 may be provided on the respective lane edge markers 102, as illustrated, providing a visual indication to the user that the hitting zone 112 is located in the portion of the lane which is located between the pair of hitting zone markers 110. In some embodiments, the pair of hitting zone markers 110 may be located adjacent to the marker connector 104, such that the hitting zone 112 is formed by and between the hitting zone markers 110 and the marker connector 104. In some embodiments, alternatively or additionally to having one or more hitting zone markers 110, the field game system 100 may include a club mat or standing plate 106 provided in the hitting zone 112 to provide a suitable striking surface for a hitter to club a ball from, regardless of whether the system is set up on grass, dirt, sand or another surface. The club mat or standing plate 106 may also define, and serve as a visual indicator of, the hitting zone 112.

At least one game point line 114 may be provided on at least one of the lane edge markers 102 in a longitudinally spaced-apart relationship to, and located distally to, the hitting zone 112. In some embodiments, a pair of game point lines 114 may be provided on the respective lane edge markers 102, as illustrated. The purpose of the game point lines 114 will be hereinafter described.

At least one pitching line 116 may be provided on at least one of the lane edge markers 102 in a longitudinally spaced-apart relationship to, and located distally to, the game point lines 114. The at least one pitching line 116 is thus arranged farther from the hitting zone 112 than the at least one game point line 114. In some embodiments, a pair of pitching lines 116 may be provided on the respective lane edge markers 102, as illustrated. The purpose of the pitching lines 116 will be hereinafter described.

Further distally to the hitting zone 112, at least one distance marker 118, 120, 122 may be provided on at least one of the lane edge markers 102 in spaced-apart relationship to the pitching lines 116 and with respect to each other. In some embodiments, the distance markers may include one or more pairs of distance markers, such as, but not limited to, a first pair of distance markers 118, a second pair of distance markers 120 and a third pair of distance markers 122, respectively, as illustrated. The distance markers, such as the first pair of distance markers 118, the second pair of distance markers 120 and the third pair of distance markers 122, may be located at progressively increasing distances from the hitting zone 112. For example and without limitation, in some embodiments, the first pair of distance markers 118 may be located 60 feet from the hitting zone 112; the second pair of distance markers 120 may be located 70 feet from the hitting zone 112; and the third pair of distance markers 122 may be located 80 feet from the hitting zone 112. In alternative embodiments, the number and spacing of the distance markers with respect to the hitting zone 112 may vary.

In some embodiments, at least one finish marker 124 may be provided on at least one of the lane edge markers 102, distally to the distance markers 118, 120, 122 and in spaced-apart relationship with the third pair of distance markers 122 at or near a second or distal end of the lane edge markers 102. The finish markers 124 may be disposed at a selected spacing with respect to the third pair of distance markers 122. For example and without limitation, in some embodiments, the finish markers 124 may be disposed at a distance of 90 feet with respect to the third pair of distance markers 122.

Figure 2:
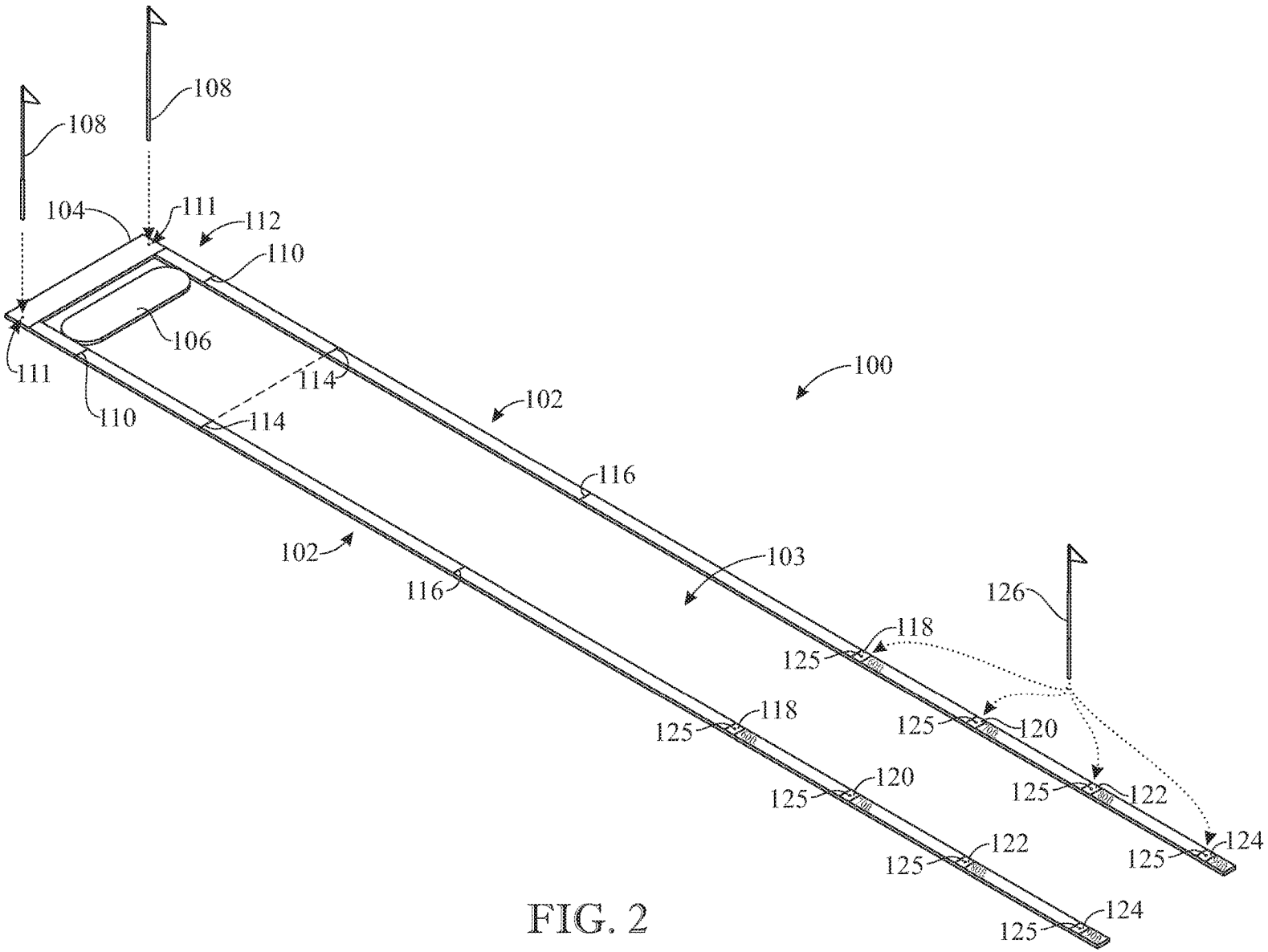
FIG. 2 presents an exploded perspective view of the field game system of FIG. 1, illustrating typical attachment of a pair of start flags to the respective lane edge markers and a finish flag to one of the lane edge markers in typical application.
Figure 3:
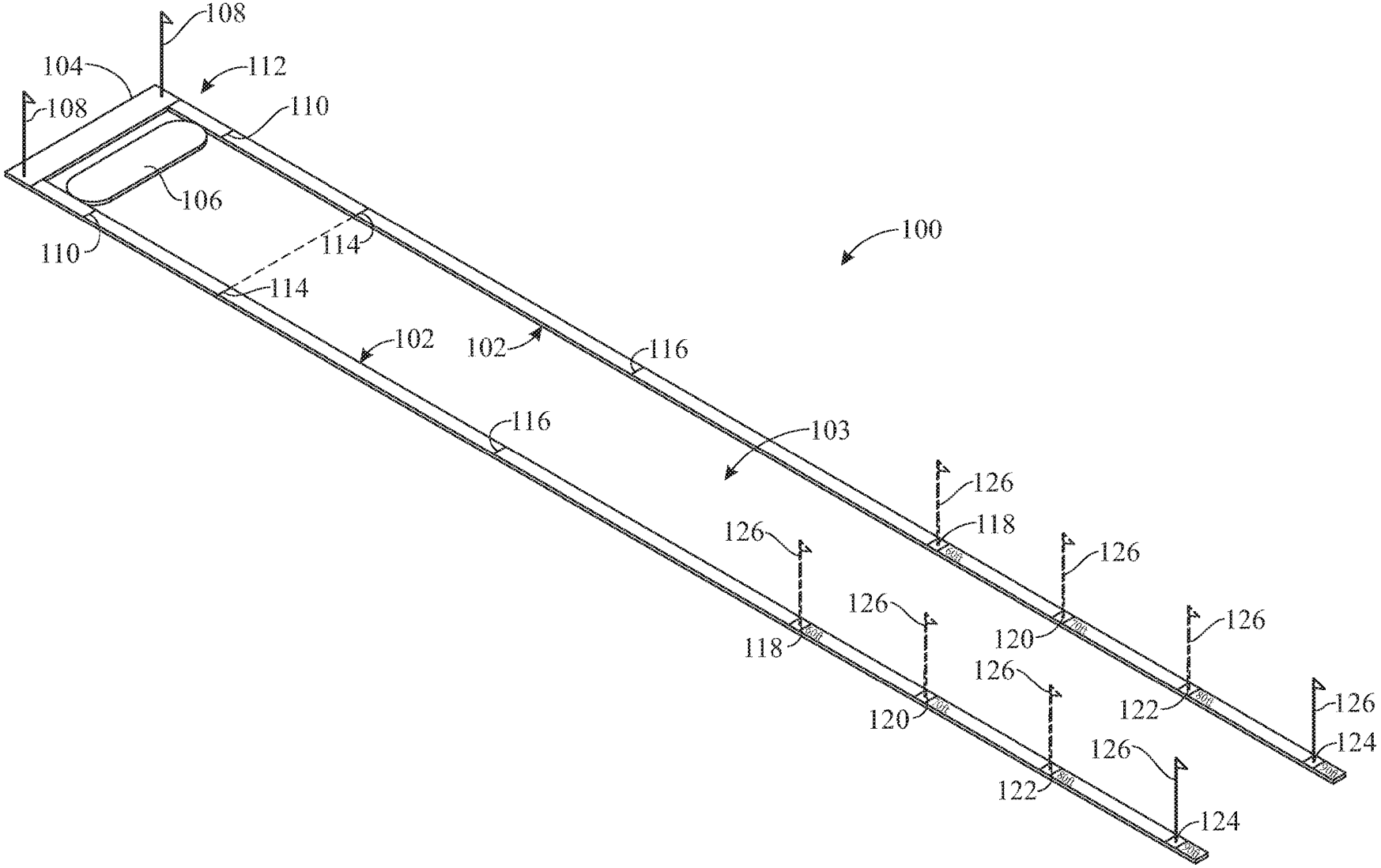
FIG. 3 presents a perspective view of the field game system of FIG. 1 with the start flags and a pair of finish flags attached to the respective lane edge markers and additionally showing, in phantom, possible attachment of the finish flags to a selected pair of distance markers on the respective lane edge markers.

As further illustrated in FIGS. 1-3, in some embodiments, at least one start indicator, sign or flag 108 providing a visual indication of the start of the lane may be deployed in upward-standing relationship from at least one of the lane edge markers 102 at the hitting zone 112. Similarly, at least one finish indicator, sign or flag 126 may be deployed in upward-standing relationship from at least one of the lane edge markers 102 providing a visual indication of the end of the lane may be deployed at the finish marker or markers 124, as illustrated in FIG. 1. Alternatively or additionally, as illustrated in FIG. 2 and in phantom in FIG. 3, at least one finish flag 126 may be deployed at one of the first pair of distance markers 118, the second pair of distance markers 120, the third pair of distance markers 122. For example, the at least one finish flag 126 may be selectively and interchangeably placed at either the first pair of distance markers 118, the second pair of distance markers 120 or the third pair of distance markers 122 to adjust the running distance for purposes which will be hereinafter described.

Figure 9:
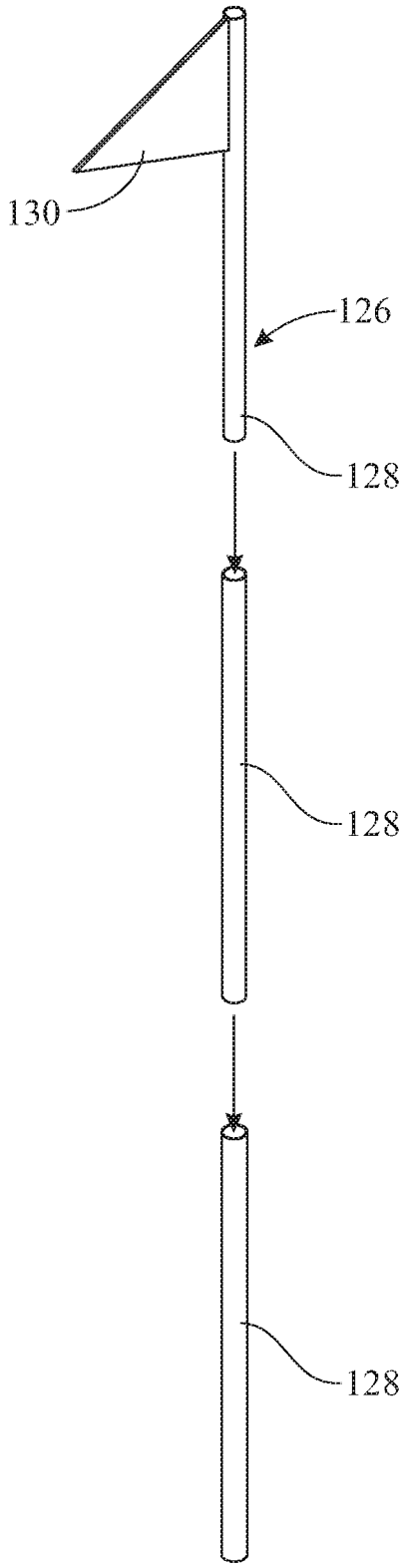
FIG. 9 presents an exploded, front perspective view of a disassembled finish flag (or start flag) according to an illustrative embodiment of the field game system of the present invention.
Figure 10:
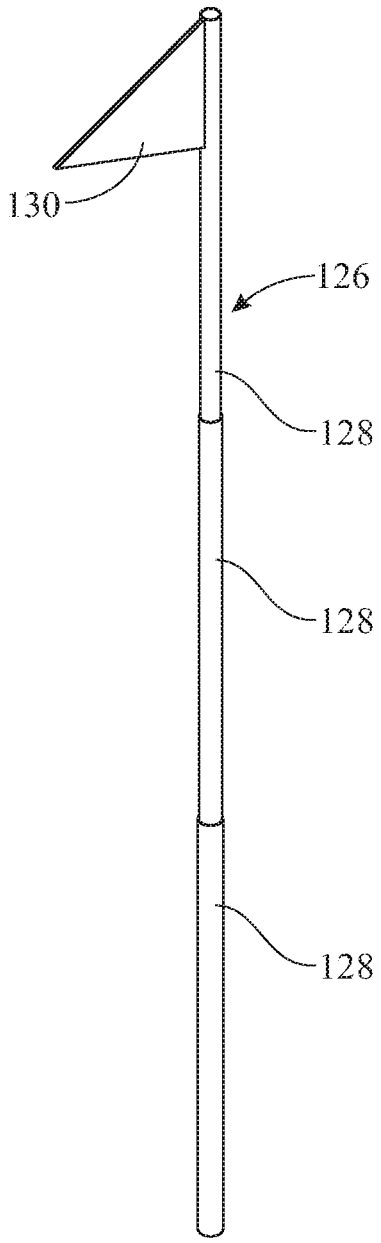
FIG. 10 presents a front perspective view of a typical assembled finish flag (or start flag) according to an illustrative embodiment of the field game system of the present invention.

As illustrated in FIGS. 9 and 10, each finish flag 126 may include multiple flag segments 128 which can be attached to each other in end-to-end relationship according to the knowledge of those skilled in the art. A flag panel 130 may extend from an uppermost one of the flag segments 128.

Accordingly, each finish flag 126 may be selectively assembled by attaching the flag segments 128 to each other and selectively disassembled for compact and space-efficient transport and/or storage by detaching the flag segments 128 from each other. In other embodiments, the multiple flag segments 128 may form a telescopically-adjustable body which can be extended and retracted. Each start flag 108 may have a design which is the same as or similar to that of each finish flag 126 and described with reference to FIGS. 9 and 10.

Each start flag 108 and each finish flag 126 may be attached to the corresponding lane edge marker 102 according to any suitable technique which is suitable for the purpose. In some embodiments, for each start flag 108, a flag opening 111 (FIG. 2) may be provided in at least one of the lane edge markers 102 at the location of the hitting zone 112. The lower end of the lowermost flag segment 128 of the start flag 108 may be inserted into the corresponding selected flag opening 111 to mark the location of the hitting zone 112. Similarly, for each finish flag 126, a flag opening 125 may be provided in at least one of the lane edge markers 102 at the location of each first distance marker 118, second distance marker 120, third distance marker 122 and finish marker 124. The lower end of the lowermost flag segment 128 of the finish flag 126 may be inserted into the corresponding flag opening to mark the location of the corresponding first distance marker 118, second distance marker 120, third distance marker 122 and/or finish marker 124.

Figure 7:
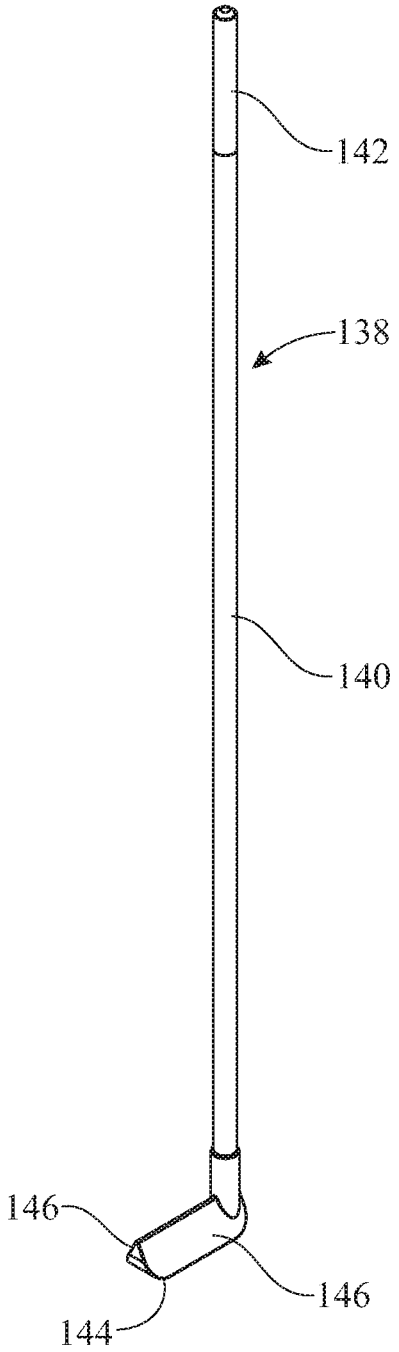
FIG. 7 presents a front perspective view of a game club according to an illustrative embodiment of the field game system of the present invention, with the game club shown in a retracted or collapsed configuration.
Figure 8:
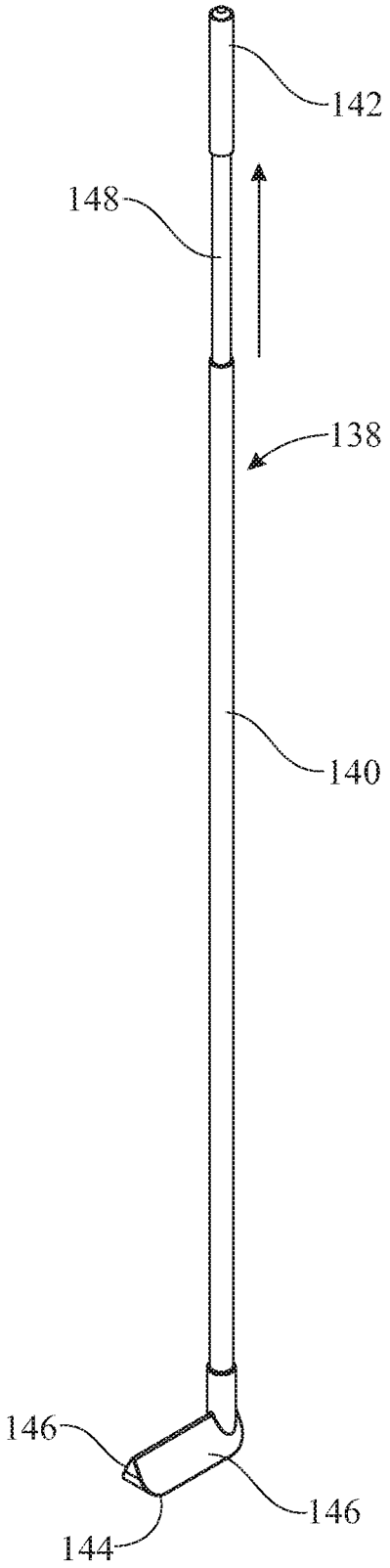
FIG. 8 presents a front perspective view of the game club illustrated in FIG. 7, shown in an extended configuration.

As illustrated in FIGS. 7 and 8, the field game system 100 may include a game club 138, the purpose of which will be hereinafter described. The game club 138 may include an elongated club shaft 140. A club handle 142 may extend from an upper end of the club shaft 140. A club head 144 may terminate a lower end of the club shaft 140. The club head 144 may have at least one strike face 146. In some embodiments, the club head 144 may have a pair of strike faces 146 to accommodate a left-handed player or a right-handed player.

Figure 4:
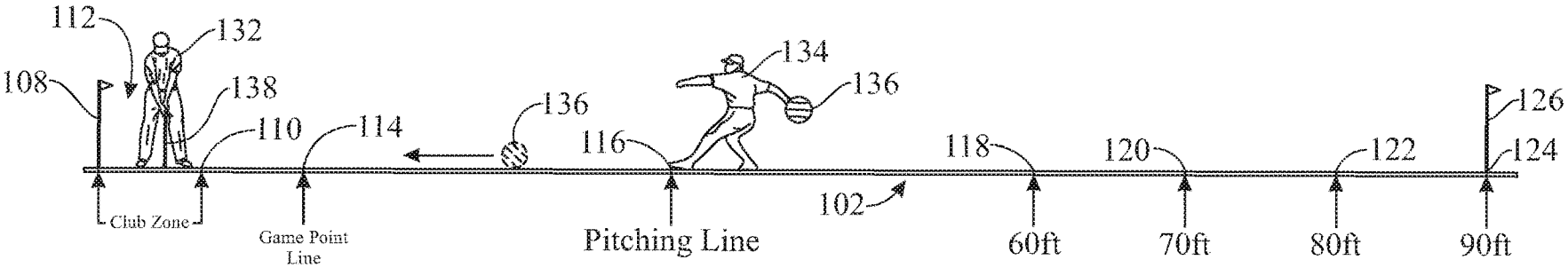
FIG. 4 presents a side view of the field game system of FIG. 1 in typical application of the field game system, with a player standing at the hitting zone and gripping a game club and a pitcher standing at the pitching line and pitching a ball toward the player to initiate play.
Figure 5:
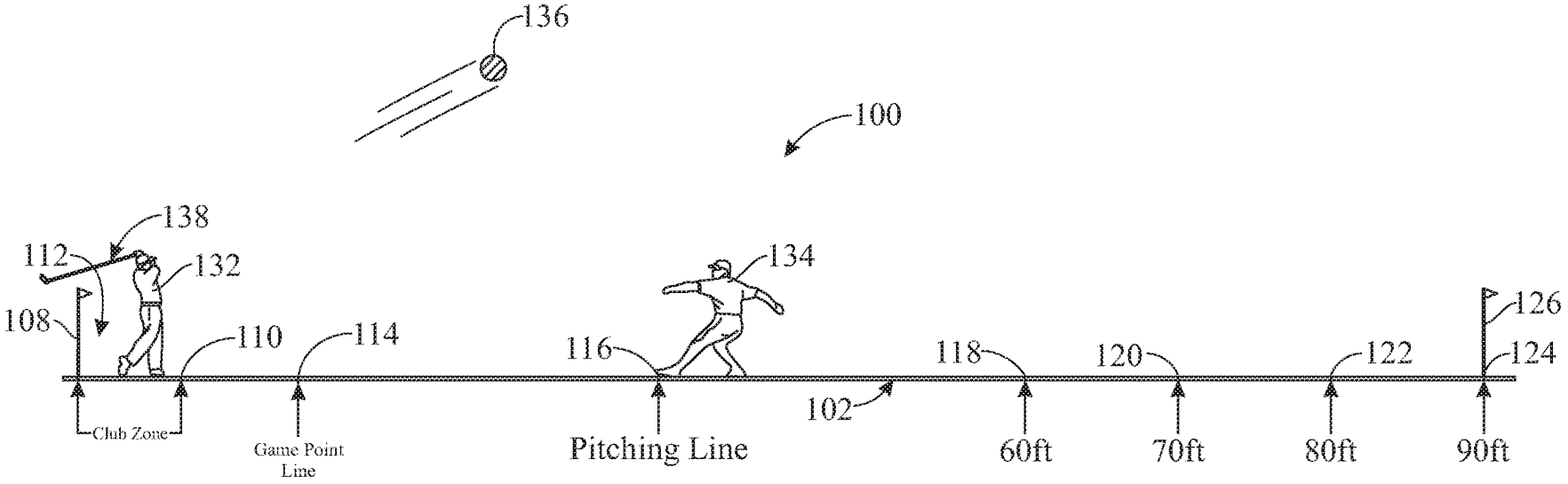
FIG. 5 presents a side view of the field game system of FIG. 1, with the player having struck the ball with the game club and the ball traveling through the air.
Figure 6:
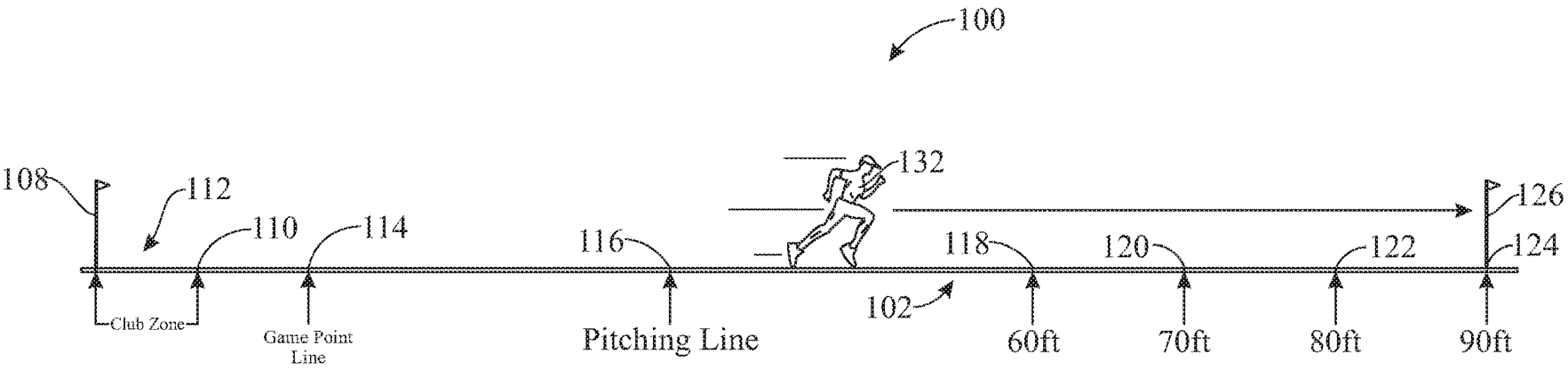
FIG. 6 presents a side view of the field game system of FIG. 1, with the player running from the hitting zone toward the finish flags after having struck the ball with the game club.

As illustrated in FIG. 8, in some embodiments, the game club 138 may be selectively length-adjustable to accord with the height and length preferences of a hitter 132 (FIG. 4). Accordingly, a shaft extension 148 may be selectively telescopically extendable from the upper end of the club shaft 140. The club handle 142 may be provided on the shaft extension 148. Thus, the shaft extension 148 may be selectively extended from the club shaft 140 to lengthen the game club 138 in implementation of the field game system 100. The shaft extension 148 may be retracted in the club shaft 140 to shorten the game club 138 for compact and space-efficient transport and/or storage.

Referring next to FIGS. 1-6, in typical application, the lane edge markers 102 of the field game system 100 may be assembled (if made of several segments or otherwise needed) and placed on the ground or other flat support surface (not illustrated) in parallel, spaced-apart relationship to each other. Accordingly, the game lane 103 (FIGS. 1-3) may be formed by and between the lane edge markers 102. The start flags 108 may be deployed in place at the hitting zone 112. The finish flags 126 may be deployed in place at the respective finish markers 124, as illustrated in FIG. 1. Alternatively, the finish flags 126 may be deployed in place at the respective first distance markers 118, second distance markers 120 or third distance markers 122, as illustrated in phantom in FIG. 3.

Multiple players may be divided into two teams with the same number of players. As in the game of baseball, the teams may take turns as the "fielding team" and the "batting team", with a pitcher 134 on the fielding team and the remaining fielding team players standing in the outfield to the sides of the lane edge markers 102. The hitters 132 on the batting team take turns holding the game club 138 and attempting to strike a game ball 136 as the pitcher 134 pitches (e.g., rolls) the game ball 136 toward the hitter 132. The fielding team and the batting team may alternate with each other throughout the game, as in the game of baseball.

As illustrated in FIG. 4, a hitter 132 on the batting team may stand on the standing plate 106 (FIGS. 1-3) in the hitting zone 112. A pitcher 134 may stand in the game lane 103 at the pitching lines 116. Outfielders (not illustrated) may stand outside the game lane 103 on opposite sides of the lane edge markers 102. The hitter 132 grips the game club 138, and the pitcher 134 pitches a game ball 136 toward the hitter 132. In some applications, the game ball 136 may roll on the game lane 103 toward the hitter 132.

As the game ball 136 approaches the hitter 132, the hitter 132 swings the game club 138 in an attempt to strike the game ball 136. In the event that he or she misses the game ball 136, the hitter 132 may be declared as having struck out. Alternatively, the hitter 132 may be provided with a set number of attempts to strike the game ball 136 before being declared struck out. In the event that the hitter 132 strikes the game ball 136 and the game ball 136 remains in the hitting zone 112 or travels out of the hitting zone 112 to the side of one of the lane edge markers 102 or behind the start flags 108, the hitter 132 may be declared as having struck out.

In the event that the hitter 132 strikes the game ball 136 and the game ball 136 travels to the outfield, the hitter 132 runs down the game lane 103 toward the finish flags 126, and the outfielders may attempt to catch the game ball 136. In the event that one of the outfitters catches the game ball 136, the hitter 132 may be declared as being "out". In the event that none of the outfitters catches the game ball 136, an outfitter may retrieve the game ball 136 and attempt to tag the hitter 132 before the hitter 132 reaches the finish flags 126. Alternatively, the outfielder may throw the ball at the hitter 132 in an attempt to strike the hitter 132 with the game ball 136. Still further in the alternative, the outfitter may throw the ball 132 to another outfitter who is closer to the hitter 132. The outfitter who catches the game ball 136 may then attempt to tag the hitter 132 or strike the hitter 132 with the ball 132. In the event that any outfielder who possesses the game ball 136 tags the hitter 132 or strikes the hitter 132 with the game ball 136 before the hitter 132 reaches the finish flags 126, the hitter 132 may be declared as being "out". In the event that the hitter 132 reaches the finish flags 126 before being tagged by an outfielder who possesses the game ball 136 or struck by the game ball 136 after it is thrown by the outfielder, the batting team may be awarded a point. Another hitter 132 on the batting team may assume the position at the hitting zone 112 and the playing procedure repeated until the hitter 132 strikes out or until an "inning" is completed. In some applications, each inning may be completed after the hitter 132 strikes out or is declared as being out a predetermined number of times, such as twice, or the team is awarded a point. The team which has the larger number of points after a predetermined number of innings may be declared the winning team.

In the event that the hitter 132 is in the hitting zone 112 for the winning point, it may be required that the hitter 132 strike the game ball 136 beyond the game point line or lines 114 on one or both of the lane edge markers 102. In the event that the game ball 136 fails to travel beyond the game point line or lines 114, the hitter 132 may be declared as being out.

At the conclusion of the game, the lane edge markers 102 may be folded or rolled up and/or disassembled. Each start flag 108 and each finish flag 126 may be disassembled by detachment of the flag segments 128, as was heretofore described with respect to FIGS. 9 and 10. The game club 138 may be deployed in the collapsed configuration illustrated in FIG. 7 typically by telescopic retraction of the shaft extension 148 into the club shaft 140, as illustrated in FIG. 8. The lane edge markers 102, start flags 108, finish flags 126 and game club 138 may be placed into a carrying bag or other container (not illustrated) for space-efficient transport and/or storage.

Figure 11:
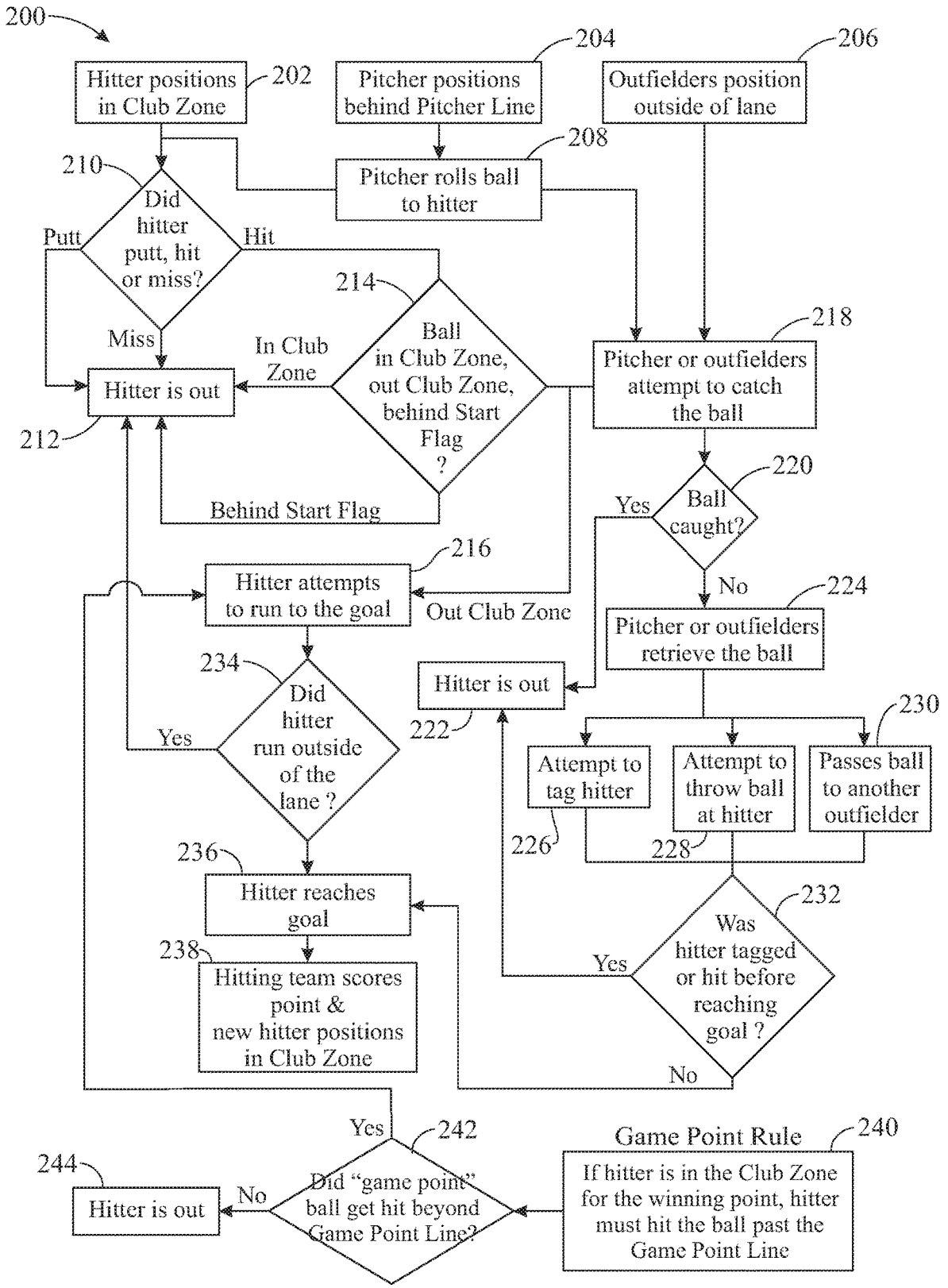
FIG. 11 presents a flow diagram of an illustrative field game method which utilizes the field game system of the present invention.

Referring next to FIG. 11, a flow diagram 200 of a typical field game method which utilizes the field game system of the present invention is illustrated. The lane edge markers 102 of the field game system 100 may be deployed in place on the ground or other flat support surface (not illustrated). At Step 202, a hitter may stand in position in the club zone or hitting zone. At Step 204, a pitcher may stand in position at the pitcher line holding a game ball. At Step 206, outfielders may stand in position outside the game lane.

At Step 208, the pitcher may roll the game ball to the hitter. At Step 210, the hitter may putt, hit or miss the game ball. In the event that the hitter putts or misses the game ball, then the hitter may be declared as having struck out at Step 212. In the event that the hitter hits the game ball and the game ball remains in the hitting zone, rolls out of the hitting zone or travels behind the start flag at Step 214, then the hitter may also be declared as having struck out at Step 212.

In the event that the hitter strikes the game ball and the game ball travels to the outfield, then the hitter may attempt to run on the game lane to the finish flag or flags at Step 216. In the event that the hitter steps outside the game lane at Step 234, the hitter may be declared as being out at Step 212.

At step 218, the pitcher or the outfielders may attempt to catch the game ball. If one of the outfielders catches the game ball at Step 220, then the hitter may be declared as being out in Step 222. If the pitcher and none of the outfielders catch the game ball, then the pitcher or one of the outfielders may retrieve the ball at Step 224. The pitcher or outfielder who possesses the game ball may attempt to tag the hitter at Step 226, throw the game ball at the hitter at Step 228 or pass the game ball to another outfielder who is closest to the hitter at Step 230. In the event that the hitter is tagged or struck with the ball before reaching the finish flag or flags at Step 232, then the hitter may be declared as being out in Step 222. In the event that the hitter is not tagged or struck with the ball before reaching the finish flag or flags at Step 236, the hitting team may score a point and then a new hitter may stand in position in the hitting zone at Step 238.

In the event that the hitter is standing in the hitting zone for the winning point, then the hitter may be required to strike the game ball beyond the game point line at Step 240. In the event that the game ball does not travel beyond the game point line at Step 242, then the hitter may be declared as being out at Step 244.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A field game system, comprising:

at least one game lane indicator comprising a pair of lane edge markers arranged in a spaced-apart relationship with one another defining an elongated game lane for running therealong, the game lane comprising a proximal end and a distal end, wherein the proximal end of the pair of lane edge markers are integrally joined by a connector, and the distal end of the pair of lane edge markers are not joined but independent of one another;

at least one hitting zone indicator indicating a hitting zone within the game lane to be occupied by a hitter for the hitting of a ball;

at least one pitching zone indicator indicating a pitching zone within the game lane to be occupied by a pitcher, wherein the pitching zone is arranged distally to the hitting zone; and at least one running distance indicator indicating one or more specific running distances with respect to the hitting zone, wherein the one or more specific running distances are located distally to the hitting zone, and wherein the pitching zone indicator and pitching zone are located superior to the hitting zone but inferior to the running distance indicator.

2. The system of claim 1, wherein each lane edge marker comprises a flexible band.

3. The system of claim 1, wherein the at least one hitting zone indicator comprises at least one hitting zone mark on at least one of the lane edge markers.

4. The system of claim 1, wherein the at least one pitching zone indicator comprises at least one visible mark on at least one of the lane edge markers.

5. The system of claim 1, wherein the at least one running distance indicator comprises at least one visible mark on at least one of the lane edge markers.

6. The system of claim 5, wherein the at least one running distance indicator comprises a plurality of pairs of visible marks arranged along the lane edge markers at increasing distances from the hitting zone.

7. The system of claim 1, wherein the at least one hitting zone indicator comprises a standing plate.

8. The system of claim 1, wherein the at least one hitting zone indicator and hitting zone are located at a proximal end of the game lane.

9. The system of claim 1, further comprising at least one game point indicator indicating a transverse game point line at a position along the game lane which is located superior to the hitting zone and inferior to the pitching zone.

10. The system of claim 9, wherein the at least one game point indicator comprises at least one visible mark on at least one of the lane edge markers.

11. The system of claim 1, further comprising one or more ball-hitting devices configured to allow a hitter in the hitting zone to hit a ball pitched to the hitter from the pitching zone.

12. The system of claim 11, wherein the one or more ball-hitting devices comprise a club.

13. The system of claim 11, further comprising a ball configured to be hit by the one or more ball-hitting devices.

14. The system of claim 1, further comprising one or more flags configured to provide a visual reference of at least one of the hitting zone, the pitching zone and the one or more specific running distances.

15. The system of claim 14, wherein the one or more flags are located on the pair of lane edge markers.

16. The system of claim 15, wherein the one or more flags are removably fitted within one or more corresponding openings in the pair of lane edge markers.

17. The system of claim 16, wherein the one or more flags are height-adjustable.

18. A field game system, comprising:

a pair of lane edge markers arranged in a spaced-apart relationship with one another defining a game lane therebetween for running therealong, the game lane comprising a proximal end and a distal end;

a zone line indicator disposed about the pair of lane edge markers, wherein the proximal end of the pair of lane edge markers are integrally joined by a connector, and the distal end of the pair of lane edge markers are not joined but independent of one another;

at least one hitting zone extending between a lateral edge of the connector and the zone line indicator and within the game lane, the hitting zone to be occupied by a hitter for the hitting of a ball;

at least one pitching zone indicator indicating a pitching zone within the game lane to be occupied by a pitcher, wherein the pitching zone is arranged distally to the hitting zone; and at least one running distance indicator indicating one or more specific running distances with respect to the hitting zone, wherein the one or more specific running distances are located distally to the hitting zone, and wherein the pitching zone indicator and pitching zone are located superior to the hitting zone but inferior to the running distance indicator.

19. A field game system, comprising:

a pair of flexible lane edge markers configured to switch from a folded or rolled storage configuration to a deployed configuration in which the lane edge markers are deployed in a spaced-apart relationship with one another defining a game lane therebetween for running therealong, the game lane comprising a proximal end and a distal end;

a zone line indicator disposed about the pair of lane edge markers, wherein the proximal end of the pair of lane edge markers are integrally joined by a connector, and the distal end of the pair of lane edge markers are not joined but independent of one another;

at least one hitting zone extending between a lateral edge of the connector and the zone line indicator within the game lane, the hitting zone to be occupied by a hitter for the hitting of a ball;

at least one pitching zone indicator indicating a pitching zone within the game lane to be occupied by a pitcher, wherein the pitching zone is arranged distally to the hitting zone;

at least one running distance indicator indicating one or more specific running distances with respect to the hitting zone, wherein the one or more specific running distances are located distally to the hitting zone, and wherein the pitching zone indicator and pitching zone are located superior to the hitting zone but inferior to the running distance indicator;

one or more flags configured to provide a visual reference of at least one of the hitting zone, the pitching zone and the one or more specific running distances; and a ball-hitting device configured to allow a hitter in the hitting zone to hit a ball pitched to the hitter from the pitching zone.

* * * * *